United States Patent [19]

Knoke et al.

[11] 4,373,000

[45] Feb. 8, 1983

[54] SOFT, DRAPABLE, NONWOVEN INTERLINING FABRIC

[75] Inventors: Jürgen Knoke, Weinheim; Manfred Jöst, Hemsbach; Erich Fahrbach; Bohuslav Tecl, both of Weinheim, all of Fed. Rep. of Germany

[73] Assignee: Firma Carl Freudenberg, Weinheim, Fed. Rep. of Germany

[21] Appl. No.: 289,068

[22] Filed: Jul. 31, 1981

[30] Foreign Application Priority Data

Oct. 13, 1980 [DE] Fed. Rep. of Germany ..... 3038664

[51] Int. Cl.[3] ..... B32B 27/14

[52] U.S. Cl. ..... 428/198; 428/195; 428/218; 428/224; 428/284; 428/288; 428/296; 428/298; 428/373; 428/374

[58] Field of Search ..... 428/113, 114, 195, 198, 428/284, 288, 297, 373, 374, 298, 212, 218, 296

[56] References Cited

U.S. PATENT DOCUMENTS

| | | | |
|---|---|---|---|
| 2,464,301 | 3/1949 | Francis | 156/220 |
| 3,098,235 | 7/1963 | Gusman | 428/198 |
| 3,595,731 | 7/1971 | Davis et al. | 428/296 |
| 4,093,763 | 6/1978 | Hartmann et al. | 428/296 |

*Primary Examiner*—James J. Bell

*Attorney, Agent, or Firm*—Kenyon & Kenyon

[57] ABSTRACT

A multilayered nonwoven fabric is described which exhibits excellent resistance to drycleaning and washing abrasion but nevertheless is soft and drapable. It contains a varying amount of thermal bonding fibers in the various layers.

8 Claims, No Drawings

SOFT, DRAPABLE, NONWOVEN INTERLINING FABRIC

BACKGROUND OF THE INVENTION

The invention relates to a nonwoven interlining fabric that can be ironed-on. More specifically it relates to a fabric composed of several layers of randomly arranged staple or endless fibers, wherein the individual layers are internally bonded and are interlayer bonded by means of binders and/or bonding fibers. On at least one of the surfaces of the fabric, thermal adhesive is applied in a pattern, such as in the form of dots.

Spot-bonded, fiber-reinforced nonwoven interlining fabrics are becoming more and more important. They have a woven-fabric like character, are soft and drapable and therefore meet the apparel industry requirements for modern interlining materials. They are preferably reinforced with binder fibers. While such reinforcement is sometimes adequate, the drycleaning wear and abrasion resistance of these very soft, nonwoven interlining fabrics is not satisfactory. The abrasion and drycleaning wear resistance can be improved when the reinforcement fiber content is increased, but the hardness and stiffness of the resulting nonwoven fabric increase also. Although a certain amount of hardening of some types of very soft nonwoven fabrics can be tolerated, in general, the mere addition of 5 to 10% more binder fibers over the amount typically used in fiber reinforced nonwoven fabrics leads to hardening without appreciable improvement of the resistance to cleaning wear and abrasion.

It is an object of the invention, therefore, to develop a very soft nonwoven fiber reinforced interlining fabric which is highly resistant to abrasion and dry cleaning wear. A further object is the development of a thin and soft modern fabric which is easily drapable and exhibits high resistance to drycleaning wear.

SUMMARY OF THE INVENTION

According to the invention, there has been developed a nonwoven interlining fabric which can be joined to outer fabrics by means of thermal adhesive and a process such as ironing. The fabric comprises several consecutive layers of randomly and/or parallel arranged staple or endless fibers, wherein the individual layers are internally bonded and interlayer bonded by means of thermal bonding fibers. On at least one of the surfaces of the fabric a thermal adhesive is applied in pattern-fashion. The different layers of the nonwoven fabric have differing contents of bonding fibers and when the thermal adhesive is applied on one surface, the surface layer used is the one with the lowest bonding fiber content.

DETAILED DESCRIPTION OF THE INVENTION

According to the invention, the bonding fiber content varies in the individual layers of the fabric in such a way that the layer with the lowest bonding fiber content is printed with the thermal adhesive pattern. This layer may even be completely free of bonding fibers. Surprisingly, such a nonwoven interlining fabric is highly resistant to drycleaning wear. It is believed that this is due to the fact that after being ironed-on, the "underside" which is low in or free of bonding fibers and is coated with adhesive, is stressed less in drycleaning than the "top side" which contains more bonding fibers. Therefore, the nonwoven interlining fabric of the invention achieves a fundamental improvement of resistance to abrasion and drycleaning or washing wear. Moreover, the nonwoven interlining fabric can be used with very thin and soft outer materials which would not work with conventional interlining materials.

Preferred embodiments of the invention are those nonwoven interlining fabrics which can be ironed-on, which contain an interrupted adhesive pattern and wherein the fiber layers are laid down cross-wise. It is preferred to use thermal adhesive for the surface adhesive and, where the layers coated with the adhesive pattern contain 0 to 30% by weight of the thermal bonding fibers used as binders. Preferably, only the exposed face layer contains a substantially higher share of bonding fibers, such as 30 to 100% or preferably 30 to 60%. The preferred thermal bonding fibers include bicomponent fibers of polyethylene terephthalate/polybutylene terephthalate, or of polyethylene terephthalate/copolyesters, or bicomponent fibers of nylon 66/ nylon 6.

The multilayer structure of the fabric is advantageously built up so that 40 to 80% by weight, relative to the total weight of the layers comprises the layer or layers with lower thermal bonding fiber content.

In German Pat. No. 22 60 677, a nonwoven interlining fabric of several fiber layers is described which is reinforced by a chemical binder and contains a preferably dot-shaped adhesive pattern. This nonwoven interlining fabric, however, does not have a bonding fiber distribution according to the invention. Moreover, while this fabric has zones having different amounts of binder, these zones of varying binder concentrations do not have an arrangement which is similar to that of the present invention. The fiber layers deposited on top of each are jointly impregnated with the chemical binder, which is applied with a varying concentration in such a manner that parallel runs of differing chemical binder concentrations extend over the entire width of the nonwoven fabric. With appropriate cutting, an interlining material of varying stiffness is then obtained. For example, when used as an interlining of a lounge jacket, the shoulder and breast portion are stiffened more than the lower edge of the jacket. Therefore the known, multilayer nonwoven interlining fabrics do not relate to the present soft nonwoven interlining fabric and they are not useful as interlining fabrics in combination with thin and soft outer materials nor are they drapable in all respects.

The nonwoven interlining material according to the invention comprises at least 2 but preferably at least 3 layers of fibers, the bonding fiber content of which varies in the individual layers. For example, when working with 3 cards to produce 3 layers, it is sufficient if 2 layers contain only little, i.e., up to 30% by weight of the bonding fibers relative to the total weight of thermal bonding fibers, or the layer coated with the thermal adhesive pattern, or both layers, may be free of bonding fibers. These layers are therefore weakly bonded and are still extremely soft. Although this "underside" is not very resistant to drycleaning wear, a very good wear resistance is nevertheless obtained after the fabric is ironed onto the textile outer material. The exposed fabric face layer has the higher bonding fiber content if the adhesive pattern is applied on one side. This bonding fiber content must be at least 30% by weight, relative to the total weight of the bonding fibers of the fabric. Moreover, up to 100% of the bonding fibers may be contained in this layer. Thus, the range of bonding fibers within the exposed fabric face layer is within the range of about 30 to 100% by weight relative to the total weight of bonding fibers Since the layers which are low in bonding fiber are very soft, they determine the overall character of the nonwoven interlining fabric. As compared with a conventional multilayer nonwoven interlining fabric such as that described in German Pat. No. 22 60 677, which contains bonding fibers uniformly distributed over all three layers, completely new product properties are obtained.

Especially surprising is the fact that even with a bonding fiber content of 0% on the side coated with the adhesive, good thermal adhesion is nevertheless obtained when the interlining fabric is joined to an outer material. It is believed that this is due to the fact that the high bonding fiber content of the exposed face layer causes somewhat of a "piercing through" and makes possible a weak bonding of the inner layers.

Conventional thermal bonding fibers which have melting points lower than the fibers to be bonded are suitable as bonding fibers. Thus, for example, appropriate fibers are obtained from "Perlon" mixed with polyester fibers or nylon-66 fibers. Polyethylene-terephthalate fibers can be bonded with good results to copolyester fibers. Preferably, however, bicomponent fibers such as core-jacket fibers of nylon 6/nylon 66 are used. Also, "side-by-side fibers" are highly suitable. In addition nylon-66/ nylon-6 bicomponent fibers, fibers of polyethylene terephthalate/polybutylene terephthalate or polyethylene terephthalate/copolyester are preferred and these fibers may be of the core-jacket or the "side-by-side" type. Other bicomponent fibers are suitable provided they are composed of 2 components with different melting points.

All synthetic fibers with a melting point higher than the bonding fibers are suitable as cofibers forming the web of the nonwoven fibric, especially polyamide 66 and polyethylene terephthalate. For some purposes, it is desirable to admix cellulose wool, cotton or wool.

It is preferrable to produce a nonwoven fabric of the invention wherein the fibers are laid in a random or crosswise direction. Also, a lengthwise orientation of the fibers can be used as well as combinations of random, crosswise and lengthwise.

The multilayer nonwoven interlining fabric is coated the thermal adhesive, the pattern of which can be adapted to the respective application. For most applications, however, dot coating is preferred. Suitable thermal adhesives include the customary products such as terpolyamides with a melting range around 120° C. or copolyesters or low-density polyethylene. The adhesive must always be applied on that side which has the lower or no content of thermal bonding fibers.

The nonwoven interlining fabrics according to the invention, which can be ironed-on, are useful in men's and women's outerwear and are well suited for lightweight, soft and drapable materials. However, they are also usable in particular for men's suits and ladies' suits as well as for overcoats or wherever a soft but nevertheless abrasion resistant interlining is desired.

EXAMPLE 1

In an apparatus with 3 carders, a nonwoven fabric was carded, where the first carder deposited a fiber layer with a fiber mixture comprising 45% by weight relative to the total weight of the fibers, of a 3.3 nylon-66 homofil fiber and of 55% by weight of a bicomponent core-jacket fiber (3.3 dtex) of 50% nylon-66 and 50% nylon-6. The other two carders deposited a fiber layer which comprised 10% by weight of the bicomponent core-jacket fiber and 90% by weight of the foregoing 3.3 dtex nylon-66 homofil fiber. The layers were placed on top of each other by means of a cross-laying device. The weight of each layer was the same and calculated to produce a final weight of the nonwoven web of 60 g/m$^2$.

The web was bonded in a calendar at 225° C., where one of the steel cylinders was smooth and the other one was engraved ($0.55\times0.8\times0.65$ dot dimension, 30 dots/cm$^2$, dot spacing in horizontal rows, 2.1 mm; in vertical rows, 1.6 mm). The cylinders were arranged so that the web layer with the large bicomponent fiber content contacted the engraved cylinder. The pull-off velocity was 10 m/min and the calendering produced the nonwoven fabric bonded by the bicomponent fibers. A thermal adhesive 20 g/m$^2$ of terpolyamide nylon-66/nylon-6/nylon-12 with a melting point of about 120° C. was applied in dot-fashion on the side of the nonwoven fabric which contained the smaller amount of bicomponent fibers. The thermal adhesive was bonded to the fabric by using a smooth calendar cylinder. The nonwoven interlining fabric made in this manner exhibited a soft, pleasant feel, textile-like draping and unusually high resistance to abrasion in dry and wet condition. The nonwoven interlining fabric was resistant to wear resulting from wet washing and drycleaning. It was suitable as interlining that could be ironed-on to outerwear of any kind.

COMPARISON TEST

In the same apparatus as in Example 1 and in the same manner, three layers of fibers having homogeneous composition were carded. All three layers contained 25% by weight of the bicomponent fiber in Example 1 given and 75% nylon-66 with 3.3 dtex. The average fiber composition thus corresponded to that of Example 1. The transversely arranged fabric was bonded as in Example 1 and subsequently coated dot-wise with 20 g/m$^2$ of thermal adhesive. The base material weight was 60 g/m$^2$.

The nonwoven interlining fabric obtained in this manner exhibited the same feel and textile-like draping as in Example 1. The resistance to dry and wet abrasion as well as to wear from washing and drycleaning, however, was considerably worse. The difference became even more pronounced after 5 washings and 5 drycleanings.

We claim:

1. A nonwoven interlining fabric capable of being joined to a textile material by means of a thermally activatable adhesive on the surface of said fabric adapted to be in contact with said textile material, said fabric comprising at least two layers, each layer being comprised of staple or endless fibers in random and/or parallel arrangement and at least all less one of such layers containing thermal bonding fibers, said layers being bonded internally and to each other by means of said thermal bonding fibers to form a fabric having a facing surface adapted to be joined to said textile material, said facing surface being that of said layer having, relative to all other layers of said fabric, the lowest distribution of thermal bonding fibers, said surface having applied thereto a patterned arrangement of thermally activatable adhesive.

2. A nonwoven interlining fabric capable of being joined to a textile material by means of a thermally activatable adhesive on the surface of said fabric adapted to be in contact with said textile material, said fabric comprising a first upper layer and at least one additional layer below said upper layer, each of said upper and additional layers being comprised of staple or endless fibers in random and/or parallel arrangement, said additional layers further containing thermal bonding fibers in varying amounts, said upper and additional layers being bonded internally and to each other by means of said thermal bonding fibers to form a fabric having a facing surface adapted to be joined to said textile material, said facing surface being that of said upper layer, said facing surface having applied thereto a patterned arrangement of thermally activatable adhesive.

3. A nonwoven interlining fabric capable of being joined to a textile material by means of a thermally activatable adhesive on the surface of said fabric adapted to be in contact with said textile material, said fabric comprising layers comprised of staple and/or endless fibers in random and/or parallel arrangement and thermal bonding fibers in varying amounts, the distribution of said thermal binding fibers being lowest in the layer of said fabric adapted to be in contact with said textile material and said layer having applied thereon a patterned arrangement of thermally activatable adhesive, said layers being bonded internally and to each other by means of said thermal bonding fibers.

4. The nonwoven interlining fabric according to claims 1, 2 or 3 wherein said bonding fibers are bicomponent fibers selected from the group consisting of nylon-66/nylon-6, polyethylene terephthalate/polybutylene terephthalate and polyethylene terephthalate/-copolyester.

5. The nonwoven interlining fabric according to claims 1, 2 or 3 wherein said fibers of said layers are synthetic fibers.

6. The nonwoven interlining fabric according to claims 1, 2 or 3 wherein said layers are arranged such that the fibers thereof are crosswise to each other.

7. The nonwoven lining according to claims 1, 2 or 3 wherein said patterned arrangement of thermally activatable adhesive is a dot-like pattern.

8. The nonwoven interlining fabric according to claim 1 wherein said layer having the lowest distribution of thermal bonding fibers contains from 0 to 30% thermal bonding fibers by weight, relative to the total weight of thermal bonding fibers in said fabric.

* * * * *